US005698507A

United States Patent [19]

Gorlin et al.

[11] Patent Number: 5,698,507

[45] Date of Patent: Dec. 16, 1997

[54] NONAQUEOUS GELLED AUTOMATIC DISHWASHING COMPOSITION

[75] Inventors: Philip A. Gorlin, Monmouth Junction; Divaker Kenkare, Asbury; Steve Phillips, Highland Park, all of N.J.

[73] Assignee: Colgate-Palmolive Co., Piscataway, N.J.

[21] Appl. No.: 716,812

[22] Filed: Sep. 10, 1996

[51] Int. Cl.[6] ..... C11D 1/72; C11D 7/08; C11D 3/386; C11D 7/18

[52] U.S. Cl. ..... 510/223; 510/220; 510/221; 510/225; 510/226; 510/229; 510/233; 510/413; 510/421; 510/434; 510/477; 510/506

[58] Field of Search ..... 510/220, 221, 510/223, 225, 226, 229, 233, 413, 421, 434, 477, 506

[56] References Cited

U.S. PATENT DOCUMENTS

| | | | |
|---|---|---|---|
| H1513 | 1/1996 | Murch et al. | 252/546 |
| 5,346,640 | 9/1994 | Leys | 252/162 |
| 5,395,541 | 3/1995 | Carpenter et al. | 252/174.12 |
| 5,531,195 | 7/1996 | Perkins | 510/294 |
| 5,618,465 | 4/1997 | Durbut et al. | 510/221 |

*Primary Examiner*—Paul Lieberman
*Assistant Examiner*—Charles Boyer
*Attorney, Agent, or Firm*—Richard Nanfeldt

[57] ABSTRACT

An automatic dishwashing compositions containing a mixture of an acid resistant protease enzyme and an acid resistant amylase enzyme have been found to be very useful in the removal of protein and carbohydrate soils from dishware at operating temperatures of 100° F. to 140° F.

4 Claims, No Drawings

NONAQUEOUS GELLED AUTOMATIC DISHWASHING COMPOSITION

FIELD OF THE INVENTION

Enzyme containing automatic dishwashing compositions having a pH of 3 to 5 are disclosed.

BACKGROUND OF THE INVENTION

It has been found to be very useful to have enzymes in dishwashing detergent compositions because enzymes are very effective in removing food soils from the surface of glasses, dishes, pots, pans and eating utensils. The enzymes attack these materials while other components of the detergent will effect other aspects of the cleaning action. However, in order for the enzymes to be highly effective, the composition must be chemically stable, and it must maintain an effective activity at the operating temperature of the automatic dishwasher. Chemical stability is the property whereby the detergent composition containing enzymes does not undergo any significant degradation during storage. This is also known as shelf life. Activity is the property of maintaining enzyme activity during usage. From the time that a detergent is packaged until it is used by the customer, it must remain stable. Furthermore, during customer usage of the dishwashing detergent, it must retain its activity. Unless the enzymes in the detergent are maintained in a suitable environment, the enzymes will suffer a degradation during storage which will result in a product that will have a decreased initial activity.

Various attempts have been made to formulate bleach-free low foaming detergent compositions for automatic dishwashing machines, containing particular low foaming nonionics, builders, filler materials and enzymes. U.S. Pat. No. 3,472,783 to Smille recognized that degradation can occur when an enzyme is added to a highly alkaline automatic dishwashing detergent.

French Patent No. 2,102,851 to Colgate-Palmolive, pertains to rinsing and washing compositions for use in automatic dishwashers. The compositions disclosed have a pH of 6 to 7 and contain an amylolytic and, if desired, a proteolytic enzyme, which have been prepared in a special manner from animal pancreas and which exhibit a desirable activity at a pH in the range of 6 to 7. German Patent No. 2,038,103 to Henkel & Co. relates to aqueous liquid or pasty cleaning compositions containing phosphate salts, enzymes and an enzyme stabilizing compound. U.S. Pat. No. 3,799,879 to Francke et al, teaches a detergent composition for cleaning dishes, with a pH of from 7 to 9 containing an amylolytic enzyme, and in addition, optionally a proteolytic enzyme.

U.S. Pat. No. 4,101,457 to Place et al teaches the use of a proteolytic enzyme having a maximum activity at a pH of 12 in an automatic dishwashing detergent.

U.S. Pat. No. 4,162,987 to Maguire et al teaches a granular or liquid automatic dishwashing detergent which uses a proteolytic enzyme having a maximum activity at a pH of 12 as well as an amylolytic enzyme having a maximum activity at a pH of 8.

U.S. Pat. No. 3,827,938 to Aunstrup et al, discloses specific proteolytic enzymes which exhibit high enzymatic activities in highly alkaline systems. Similar disclosures are found in British Patent Specification No. 1,361,386, to Novo Terapeutisk Laboratorium A/S. British Patent Specification No. 1,296,839, to Novo Terapeutisk Laboratorium A/S, discloses specific amylolytic enzymes which exhibit a high degree of enzymatic activity in alkaline systems.

Thus, while the prior art clearly recognizes the disadvantages of using aggressive chlorine bleaches in automatic dishwashing operations and also suggests bleach-free compositions made by leaving out the bleach component, said art disclosures are silent how to formulate an effective bleach-free automatic dishwashing compositions having a pH of 3 to 5.

U.S. Pat. Nos. 3,840,480; 4,568,476; 3,821,118 and 4,501,681 teach the use of enzymes in automatic dishwashing detergents.

SUMMARY OF THE INVENTION

This invention is directed to producing an enzyme containing automatic dishwashing detergent compositions having a pH of 3 to 5 which have an increased chemical stability and essentially a constant activity of enzyme at wash operating temperatures of about 100° F. to about 140° F.

The aforementioned prior art fails to provide an automatic dishwashing detergent having a pH of 3 to 5 which contains a mixture of enzymes for the simultaneous degradation of both proteins and starches, wherein the combination of enzymes have a maximum activity at a pH of less than about 5.0 and the automatic dishwashing detergent has optimized cleaning performance in a temperature range of about 100° F. to about 140° F.

It is an object of this invention to incorporate a unique enzyme mixture of proteolytic and amylolytic enzymes in dishwasher detergent compositions having a pH of 3 to 5 which can be used in automatic dishwashing operations capable of providing performance at operating temperatures of about 100° F. to about 140° F.

Both protein soils and carbohydrate soils are extremely difficult to remove form dishware. The use of bleach in automatic dishwashing compositions helps in the removal of protein soils and high alkalinity of these automatic dishwashing compositions helps in the removal of carbohydrate soils, but even with bleach and high alkalinity these protein and carbohydrate soils are not completely removed. The use of a protease enzyme in the automatic dishwashing compositions improves the removal of protein soils such as egg and milk from dishware and the use of an amylase enzyme improves the removal of carbohydrate soils such as starch from dishware.

DETAILED DESCRIPTION OF THE INVENTION

The present invention relates to a gelled phosphate free automatic dishwashing detergent compositions which is non-corrosive and which comprises approximately by weight:

(a) 5% to 15%, more preferably 6% to 10% of citric acid;

(b) 1% to 6%, more preferably 1.5% to 3% of an alkali metal hydroxide such as sodium hydroxide;

(c) 1% to 6%, more preferably 2% to 5% of an ethylene oxidelpropylene oxide nonionic surfactant;

(d) 1% to 4%, more preferably 1.5% to 3% of a sulfonate hydrotrope such as sodium cumene sulfonate or sodium xylene sulfonate;

(e) 0.75% to 3%, more preferably 1% to 2% of hydrogen peroxide;

(f) 0.25% to 3%, more preferably 0.5% to 2% of an acid resistant amylase enzyme;

(g) 0.25% to 3%, more preferably 0.5% to 2% of an acid resistant protease enzyme;

(h) 0 to 2%, more preferably 0.1% to 1.5% of calcium chloride;

(i) 0 to 3%, more preferably 0.5% to 2.0% of sodium formate; and (j) the balance being water, wherein said composition has a neat pH of about 3.0 to about 5.0.

The liquid nonionic surfactants that can be, optionally, used in the present gelled automatic dishwasher detergent compositions are well known. A wide variety of the these surfactants can be used.

The nonionic synthetic organic detergents are generally described as ethoxylated propoxylated fatty alcohols which are low-foaming surfactants and are possibly capped, characterized by the presence of an organic hydrophobic group and an organic hydrophilic group and are typically produced by the condensation of an organic aliphatic or alkyl aromatic hydrophobic compound with ethylene oxide and/or propylene oxide. Practically any hydrophobic compound having a carboxyl, hydroxy and amido or amino group with a free hydrogen attached to the nitrogen can be condensed with ethylene oxide or with the polyhydration product thereof, polyethylene glycol, to form a nonionic detergent. The length of the hydrophilic or polyoxy ethylene/propylene chain can be readily adjusted to achieve the desired balance between the hydrophobic and hydrophilic groups. Typical suitable nonionic surfactants are those disclosed in U.S. Pat. Nos. 4,316,812 and 3,630,929.

Preferably, the nonionic detergents that are used are the low foaming poly-lower alkoxylated lipophiles, wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol has about 9 to about 18 carbon atoms and wherein the number of moles of lower alkylene oxide (of 2 or 3 carbon atoms) is from about 3 to about 15. Of such materials it is preferred to employ those wherein the higher alkanol is a high fatty alcohol having about 9 to about 11 or about 12 to about 15 carbon atoms and which contain from about 5 to about 8 or about 5 to about 9 lower alkoxy groups per mole. Preferably, the lower alkoxy is ethoxy but in some instances, it may be desirably mixed with propoxy, the latter, if present, usually being minor (no more than 50%) portion. Exemplary of such compounds are those wherein the alkanol has about 12 to about 15 carbon atoms and which contain 7 ethylene oxide groups per mole.

Useful nonionics are represented by the low foaming Plurafac series from BASF Chemical Company which are the reaction product of a higher linear alcohol and a mixture of ethylene and propylene oxides, containing a mixed chain of ethylene oxide and propylene oxide, terminated by a hydroxyl group. Examples include Product A (a $C_{13}$–$C_{15}$ fatty alcohol condensed with 6 moles ethylene oxide and 3 moles propylene oxide), Product B (a $C_{13}$–$C_{15}$ fatty alcohol condensed with 7 mole propylene oxide and 4 mole ethylene oxide), and Product C (a $C_{13}$–$C_{15}$ fatty alcohol condensed with 5 moles propylene oxide and 10 moles ethylene oxide). A particularly good surfactant is Plurafac 132 which is a capped nonionic surfactant. Another group of low foam liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide. Another liquid nonionic surfactant that can be used is sold under the tradename Lutensol SC 9713.

Synperonic nonionic surfactants such as Synperonic LF D25 are especially preferred nonionic surfactants that can be used in the aqueous liquid automatic dishwasher detergent compositions of the instant invention. Other useful nonionic surfactants are Synperonic RA 30, Synperonic RA 40 and Synperonic RA 340. The Synperonic surfactants are especially preferred because they are biodegradable and low foaming.

Another useful nonionic surfactant is Industrol DW-5 manufactured by BASF.

Poly-Tergent nonionic surfactants from Olin Organic Chemicals such as Poly-Tergent SLF-18, a biodegradable, low-foaming surfactant is specially preferred for the powdered automatic dishwasher detergent compositions of this instant invention. Poly-Tergent SLF-18, a water dispersible, having a low cloud point has lower surface tension and lower foaming is very suitable for automatic dishwasher detergent.

Other useful surfactants are Neodol 25-7 and Neodol 23-6.5, which products are made by Shell Chemical Company, Inc. The former is a condensation product of a mixture of higher fatty alcohols averaging 12 to 13 carbon atoms and the number of ethylene oxide groups present averages 6.5. The higher alcohols are primary alkanols. Other examples of such detergents include Tergitol 15-S-7 and Tergitol 15-S-9 (registered trademarks), both of which are linear secondary alcohol ethoxylates made by Union Carbide Corp. The former is mixed ethoxylation product having about 11 to about 15 carbon atoms linear secondary alkanol with seven moles of ethylene oxide and the latter is a similar product but with nine moles of ethylene oxide being reacted. Another useful surfactant is Tergitol MDS-42 a mixed ethoxylation product of 13–15 cations alcohols with 10 moles of EO and 5 moles of PO.

Also useful in the present compositions as a component of the nonionic detergent are higher molecular weight nonionics, such as Neodol 45-11, which are similar ethylene oxide condensation products of higher fatty alcohols, with the higher fatty alcohol being of about 14 to about 15 carbon atoms and the number of ethylene oxide groups per mole being 11. Such products are also made by Shell Chemical Company.

In the preferred poly-lower alkoxylated higher alkanols, to obtain the best balance of hydrophilic and lipophilic moieties the number of lower alkoxies will usually be from about 40% to 100% of the number of carbon atoms in the higher alcohol, preferably about 40% to about 60% thereof and the nonionic detergent will preferably contain at least about 50% of such preferred poly-lower alkoxy higher alkanol.

The detergent formulation also contains a mixture of at least one protease enzyme and an amylase enzyme and, optionally, a lipase enzyme that serve to attack and remove organic residues on glasses, plates, pots, pans and eating utensils.

The acid resistant amylases enzymes used in the instant invention are alpha-amylases of *Bacillus amyloliquefaciens* having an activity of about 300,000 to 1,500,000 MWU/g. Typical alpha-enzymes are Tenase -1200, Tenase L-1200 and Tenase L-340 manufactured by Solvay Enzymes, Inc.

The acid resistant protease enzymes used in the instant compositions are obtained by the controlled formation of *Aspergillus neger var* and have an activity of about 1,000 to about 4,000 SAPU/g such as AFP 2000 manufactured by Solvay Enzymes, Inc. which has an activity of about 2,000 SAPU/g. Another acid resistant protease enzyme is fungal protease manufactured by Solvay Enzymes by the controlled fermentation of *Aspergillus oryzae var* having an activity of about 20,000 to about 750,000 HUT/g.

The instant compositions can optionally contain about 0.1 to 10 wt. %, more preferably 0.5 to 8 wt. % of a gelling system which comprises a blend of hydroxypropyl-cellulosic polymer and a polymer gelling or swelling agent such as propylene glycol, wherein the gelling or swelling agent comprises about 5 to about 25 wt. % of the blend.

An anti-foaming agent can be optionally used. Preferred anti-foaming agents are silicone anti-foaming agents. These are alkylated polysiloxanes and include polydimethyl siloxanes, polydiethyl siloxanes, polydibutyl siloxanes, phenyl methyl siloxanes, dimethyl silanated silica, trimethysilanated silica and triethylsilanated silica. Suitable anti-foam agents are Silicone L7604 and DB-100. Other suitable anti-foaming agents are Silicone DB 700 used at 0 to 1.5 wt. %, more preferably 0.2 to 1.0 weight %, sodium stearate used at a concentration and of 0.5 to 1.0 weight %. Another class of suitable foam depressants used at concentration levels of 0 to about 1.5 weight %, more preferably about 0.2 to about 1.0 weight %. are the alkyl phosphoric acid esters of the formula

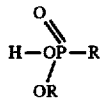

available from BASF-Wyandotte and the alkyl phosphate esters of the formula

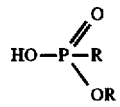

available from Hooker (SAP) and Knapsack (LPKn-158) in which one or both R groups in each type of ester may be represented independently by a $C_{12-20}$ alkyl or ethoxylated alkyl group.

The perfumes that can be optionally used at a concentration of 0.1 to 2 wt. % include lemon perfume and other natural scents. Essentially, any opacifier pigment that is compatible with the remaining components of the detergent formulation can be used. A useful and preferred opacifier is titanium dioxide.

DESCRIPTION OF THE PREFERRED EMBODIMENTS

Example 1

The concentrated aqueous liquid dishwasher detergent compositions were formulated from the following ingredients in the amounts (wt. %) specified by simple mixing at 25° C.

| | A | B | C | D | E | F | G | H |
|---|---|---|---|---|---|---|---|---|
| Citric Acid | 7.5 | 7.5 | 7.5 | 3.75 | 3.75 | 3.75 | 3.75 | 3.75 |
| Sodium hydroxide (50%) | 5.5 | 5.5 | 5.5 | 2.75 | 2.75 | 1.13 | 2.25 | 2.25 |
| Nonionic EO:PO(a) LF-18 | 4 | 4 | 4 | 4 | 4 | 4 | 4 | 4 |
| Sodium cumene sulfonate (47.5%) | 4 | 4 | 4 | 4 | 4 | 4 | 4 | 4 |
| Hydrogen peroxide (35%) | 4 | 4 | | 4 | | | | |
| Amylase Tenase L-1200 | 1 | 1 | | 1 | 1 | | | 1 |
| Fungal protease 60,000 | | 1 | | 1 | | | | |
| Calcium chloride | 1 | 1 | 1 | 1 | 1 | | | 0.5 |
| Sodium formate | | | | | | | | 0.5 |
| Water | Bal. | Bal. | Bal. | Bal. | Bal. | Bal. | Bal. | Bal. |
| Neat pH | 4.30 | 4.33 | 4.70 | 4.33 | 4.39 | 3.23 | 4.15 | 4.00 |
| % oatmeal removal | 100 | 100 | 20 | 100 | 100 | 20 | 20 | 100 |
| Filming | 1.75 | 1.88 | 1.5 | 1.88 | 1.88 | 2.13 | 2.13 | 3.25 |
| Spotting | 1.0 | 1.75 | 1.13 | 1.75 | 1.75 | 1.38 | 1.38 | 1.63 |

Laboratory Cleaning Performance

Laboratory performance of the compositions of the Examples were carried out using oatmeal. Oatmeal soil was prepared by boiling 24 grams of Quaker Oats in 400 ml of tap water for ten minutes. 3 grams of this mixture was spread as thin film onto a 7.5 inch china plate. The plates were aged for 2 hours at 80° C. (176° F.). They were then stored overnight at room temperature. Two plates of each oatmeal were used per wash. The plates were placed in the same positions in the dishwasher. 25 grams 3.5 of the detergent was used as a single dose per wash at 120° F. and 300 ppm water hardness in a GE830 dishwashing machine. The scores shown are the average of 4 machine wash cycles. Spot scores are rated on a 1–5 scale, and film scores on a 1–10 scale, with 1 being best in both cases. The soil used consists of the ASTM soil (ASTM #D3556) in addition to oatmeal-coated plates. All plates were scored by measuring the percent area cleaned. The oatmeal cleaning test results are reported above. The results tabulated were average of at least 2 runs.

What is claimed is:

1. A gelled automatic dishwashing composition having a neat pH of 3 to 5 consisting essentially of approximately by weight:

(a) 1% to 6% of a nonionic surfactant;

(b) 5% to 15% of citric acid;

(c) 0.75% to 3% of hydrogen peroxide;

(d) 0.25% to 3% of at least one acid resistant protease enzyme;

(e) 0.25% to 3% of at least one amylase enzyme;

(f) 1% to 4% of a hydrotrope;

(g) 0.1% to 1.5% of calcium chloride;

(h) 0.5% to 2% of sodium formate;

(I) 0.1% to 10% of a gelling system comprising a blend of hydroxy propyl cellulosic polymer and a swelling agent, where the swelling agent is propylene carbonate; and (j) the balance being water.

2. The composition of claim 1, further including a lipase enzyme.

3. The composition of claim 1, further including an antifoaming agent.

4. The composition of claim 1, further including an alkali metal hydroxide.

* * * * *

UNITED STATES PATENT AND TRADEMARK OFFICE

CERTIFICATE OF CORRECTION

PATENT NO. : 5,698,507

DATED : December 16, 1997

INVENTOR(S) : Philip A. Gorlin, et. al.

It is certified that error appears in the above-identified patent and that said Letters Patent is hereby corrected as shown below:

Title page, item [54] and col. 1,

Title should read "Aqueous Gelled Automatic Dishwashing Composition"

Signed and Sealed this

Thirtieth Day of November, 1999

*Attest:*

*Attesting Officer*

Q. TODD DICKINSON

*Acting Commissioner of Patents and Trademarks*